US006352126B1

(12) United States Patent
Brown

(10) Patent No.: US 6,352,126 B1
(45) Date of Patent: Mar. 5, 2002

(54) FINISH DIRT SCRAPER WITH IMPROVED DAMPING DEVICE

(76) Inventor: Dennis A. Brown, 19923 State Hwy. 141, Dexter, MO (US) 63841

( * ) Notice: Subject to any disclaimer, the term of this patent is extended or adjusted under 35 U.S.C. 154(b) by 0 days.

(21) Appl. No.: 09/546,027

(22) Filed: Apr. 10, 2000

(51) Int. Cl.[7] ..... E02F 3/76

(52) U.S. Cl. ..... 172/779.5; 172/684.5; 267/34

(58) Field of Search ..... 267/34, 221; 188/318, 188/322.21; 37/439; 172/779.5, 684.5, 779, 795

(56) References Cited

U.S. PATENT DOCUMENTS

| | | | | | |
|---|---|---|---|---|---|
| 2,619,748 | A | * | 12/1952 | McIntosh | 37/141 |
| 3,464,129 | A | * | 9/1969 | Bogenschutz | 37/50 |
| 3,889,404 | A | * | 6/1975 | Eftefield | 37/126 |
| 4,125,950 | A | * | 11/1978 | Mashford | 37/41 |
| 4,131,266 | A | * | 12/1978 | Carter | 267/34 |
| 4,359,102 | A | * | 11/1982 | Gurries et al. | 172/40 |
| 4,389,800 | A | * | 6/1983 | Goby | 37/124 |
| 5,185,946 | A | * | 2/1993 | Farrell | 37/231 |
| 5,289,880 | A | * | 3/1994 | Barto | 172/779.5 |
| 5,307,570 | A | | 5/1994 | Brown | 37/439 |
| 5,407,015 | A | * | 4/1995 | Swords et al. | 172/200 |
| 5,794,714 | A | | 8/1998 | Brown | 172/799.5 |
| 5,833,012 | A | * | 11/1998 | Pierce et al. | 172/199 |
| 6,079,725 | A | * | 6/2000 | Lazaros | 280/250.1 |

* cited by examiner

*Primary Examiner*—Thomas B. Will
*Assistant Examiner*—Kristine Markovich
(74) *Attorney, Agent, or Firm*—Haverstock, Garrett & Roberts LLP

(57) ABSTRACT

A dampening device for use with conventional finish dirt scrapers characterized by a shaft with the lower end of the shaft attached to a skid shoe and the upper end of the shaft having a piston mounted thereon which operates in a cylinder, wherein the cylinder has a divider containing an orifice which separates the chamber into a lower chamber and an upper chamber and a by-pass oil line with the upper end opening into the upper cylinder chamber and the lower end opening into the lower cylinder chamber below the piston so that the cylinder operates in a closed oil system in which the oil helps minimize bounce as the piston moves up and down, and a compression-expansion spring surrounding the shaft with the upper end abutting the bottom of the cylinder and the lower end rotatably attached to the skid shoe, the piston and spring working in unison to dampen the normal bounce of the bucket on finish dirt scrapers.

5 Claims, 2 Drawing Sheets

FINISH DIRT SCRAPER WITH IMPROVED DAMPING DEVICE

FIELD OF THE INVENTION

This invention relates to a finish dirt scraper with an improved damping device in the nature of a coil compression spring and hydraulic system working in combination.

BACKGROUND OF THE INVENTION

Finish scrapers to be used in land leveling operations are known in the art. U.S. Pat. Nos. 4,704,812; 3,889,404; 4,490,929; and 4,307,522 are noted in the disclosure in my U.S. Pat. No. 5,794,714 and in the disclosure in my U.S. Pat. No. 5,307,570 which are hereby incorporated in and made a part of the disclosure in this specification. This invention is an improvement over the commercial inventions disclosed and claimed in my U.S. Pat. Nos. 5,794,714 and 5,307,570.

None of the known references or any other known device is adapted to ground leveling wherein uneven terrain is partially leveled and large clumps of dirt are broken up in advance of a leveling blade and bucket in the rapid manner accomplished by using the invention described herein in greater detail.

SUMMARY OF THE INVENTION

As disclosed in my U.S. Pat. No. 5,794,714, the use of finish dirt scrapers has become an ever increasing important piece of equipment in quickly leveling ground for construction purposes. Although the commercial invention disclosed and claimed in my U.S. Pat. No. 5,794,714 was a tremendous improvement in equipment useful for quickly leveling dirt which may be contaminated with rocks and other debris, moving the finish dirt scraper rapidly results in an enhanced problem known as "bounce". The term bounce includes tendency of the cutting edge of the bucket to dig too deep or too shallow when collecting and removing a slice of dirt from the area being worked. Bounce also includes the concept of excessive vibration of the bucket during filling and transportation. Also, bounce may occur when one portion of the bucket cutting edge reaches the material being collected slightly ahead of the other edge portion of the bucket producing a horizontal bouncing effect from the bucket jumping back and forth form one side to the other in a somewhat uncontrollable manner. This has been a problem in other types of heavy equipment used to move dirt and my U.S. Pat. No. 5,307,570 discloses and claims a damping device useful in connection with controlling the bounce during the loading and transportation of large buckets of dirt and other frangible products. The damping device disclosed and claimed in my U.S. Pat. No. 5,307,570 does not function as effectively in controlling bounce in finish dirt scrapers such as disclosed and claimed in my U.S. Pat. No. 5,794,714. The damping device disclosed in my U.S. Pat. No. 5,307,570 works well for scrapers which actually load the dirt and debris, where the weight of the dirt and debris in the bucket helps control the bounce, after the initial contact of the material has been stabilized. Utilizing a finish dirt scraper, the scraper begins to load smoothly but when the force of weight from the scraper is rejected from the opposing force of the dirt, e.g. clay soil, it creates an uncontrollable bounce of the entire scraper, over time causing structural damage to the scraper, and severely hampering production of the finished dirt work.

This invention is a hydraulically controlled shock absorber system which includes a compression-expansion spring and hydraulic system working in combination.

This invention includes a compression-expansion coil spring which encircles a shaft with a piston mounted on the upper end of the shaft adapted to move up and down in a cylinder which works in a hydraulic oil. The upper end of the cylinder in which the piston operates contains a constricted orifice. In an upper projection of the sleeve, there is an additional oil reserve chamber. Thus, when the piston is moved upward forcing oil through the restricted orifice, it is partially retained in the oil reserve chamber. This creates a typically hydraulic resistance as the piston is forced upward.

In order to maintain a degree of equilibrium in the system, this invention includes an oil return line which has an upper opening in the upper oil reserve chamber and a lower opening into the lower chamber in which the piston works. Thus, oil may free flow by gravity and from compression from the upper oil reserve chamber into the chamber below the piston as the piston moves upward. Also as the piston moves upward a partial vacuum is produced below the piston in the cylinder which helps pull oil through the oil by-pass line into the space in the lower chamber of the cylinder vacated as the piston is forced upward.

When a bump in the soil is passed and the piston returns downward to its normal position, oil flows upward through the bypass oil line into the upper oil chamber and some will pass back through the orifice into the lower oil chamber in the cylinder above the piston. Thus, the system operates on a continuous basis to dampen bounce in the bucket.

The bottom of the shaft is hingedly attached to a dirt shoe which operates up and down as the finished dirt scraper traverses uneven ground. The principle function of the coil spring is to always maintain the dirt shoe on the ground and to avoid bouncing of the dirt shoe which could distort the damping effect of this invention. The dirt skid shoe has replaceable wear plates attached thereto. Each skid shoe is hingedly mounted on the bucket by means of a front hinge. The skid shoe is held in working relationship with the damping device by means of a pin and key arrangement so that it may be easily and quickly removed and replaced as it becomes worn and inoperable, or replace parts.

A breather tube projects outward from the upper portion of the upper oil reserve chamber in order to relieve any entrapped air, but which is adapted to prevent the loss of oil from the system.

The upper end of the damping device of this invention is hingedly attached to a projection extending approximately perpendicular from the rear wall of the scraper. The attachment may be by pin and key connection. The projection may be welded, bolted, or otherwise attached to the rear of the bucket and may contain a series of openings to provide additional adjustments. The skid shoe is hingedly attached to the lower portion of the bucket by means of a "U" shaped mounting bracket attached to the bottom area of the bucket and hingedly attached to the shoe.

When the shoe of the damping device of this invention makes contact with the soil, the shaft is pushed upward which causes the piston to move upward while at the same time the coil spring is compressed, thus keeping the skid shoe on the ground, which may be uneven. The flow of oil through the restricted orifice creates a predetermined flow rate inside the cylinder. This allows the bucket of the scraper to move up and down at a controlled rate to provide a more harmonious contact between the opposing forces which create bounce. The coil spring around the exposed cylinder shaft forces the skid shoe to remain on the ground.

When the shoe of the damper makes contact with the soil, the cylinder contracts slowly from the weight of the scraper, the flow of oil is restricted, with a predetermined flow rate inside the cylinder allowing the scraper to lower at a controlled rate, therefore having a more harmonious contact with the opposing force. Should the ground force exceed the weight, the process is quickly repeated because the shoe remains on the ground kept there by the coil spring around the exposed cylinder shaft uninhibited by the flow restrictor because it is free flowing in the opposite direction.

Generally, at least two damping devices of this invention are included on each finished dirt scraper. More than two may be used in particularly severe conditions and only one may be used with a particularly small finish dirt scraper.

DESCRIPTION OF THE PREFERRED EMBODIMENTS OF THE INVENTION

Figure 1:
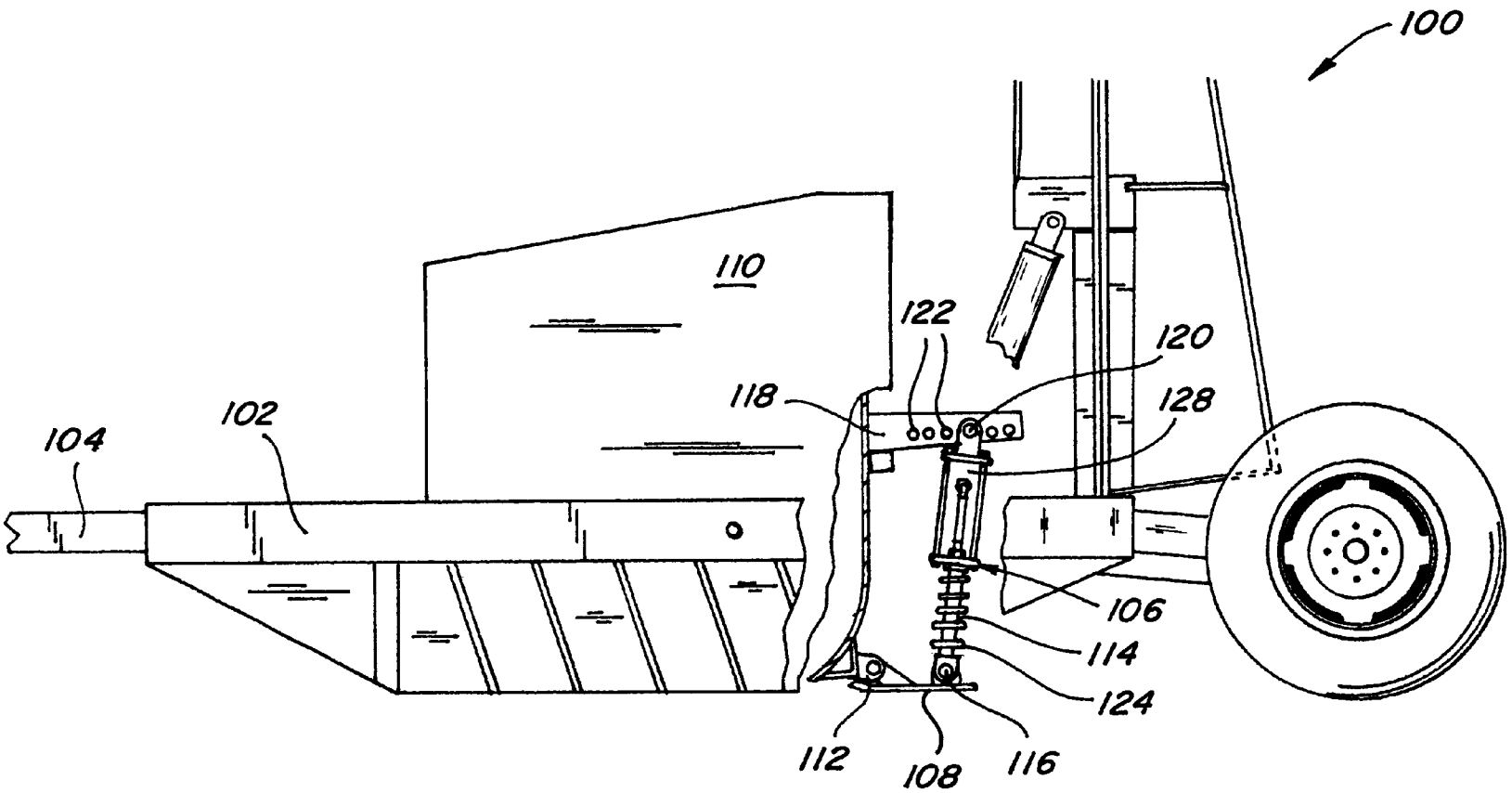
FIG. 1 is a side elevation view of the finished dirt scraper with improved damping device of the invention.
Figure 3:
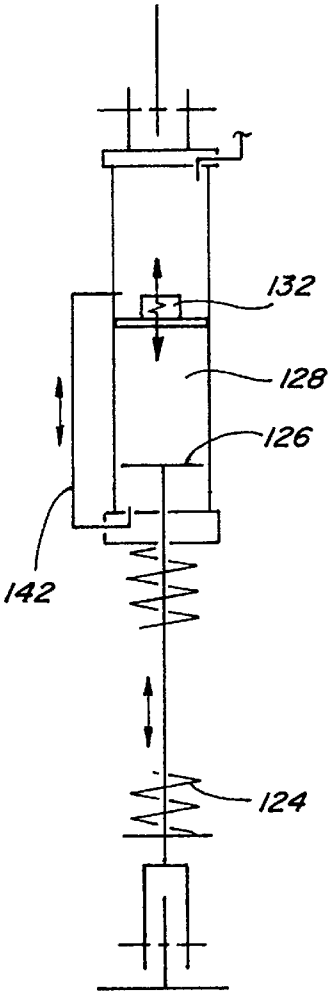
Figure 2:
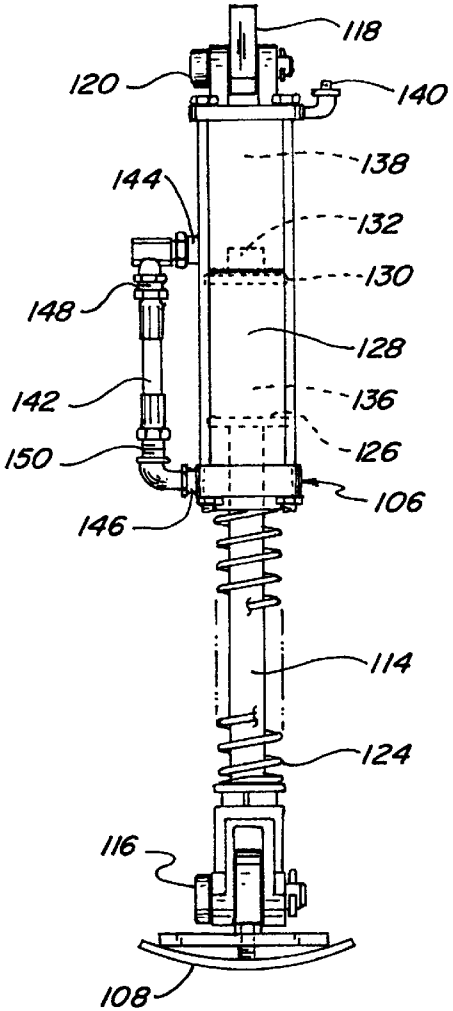
FIG. 2 is a rear elevation view of the improved damping device of this invention; and, FIG. 3 is a schematic view showing the operation of the improved damping device of this invention.

With reference to the drawings, like numbers will be used to describe like parts in FIGS. 1–3.

Referring now to FIGS. 1 & 2 wherein a preferred embodiment of the present invention for a dirt scraper and leveling device 100, is shown having a frame 102 which includes a towing bar or tongue member 104 with (not shown). Dampening device 106 includes dirt skid shoe 108 attached to bucket 110 by hinge 112 and having shaft 114 mounted on skid shoe 108 by rotary connection 116 and mounted at the top to extension arm 118 by means of pin 120 to the one of the openings 122 in extension arm 118 which is fixedly attached to bucket 110. Compression-expansions spring 124 encircles shaft 114 with piston 126 inside cylinder 128 in working relationship therewith. Cylinder 128 includes compartment divider 130 having orifice 132 to allow limited passage of oil from lower cylinder chamber space 136 into upper cylinder space 138. Upper cylinder space 138 contains optional breather 140 which is adapted to allow the exit of entrapped air without allowing oil to escape. Upper cylinder chamber space 138 also functions as an oil reservoir.

Oil return line 142 is a critically important part of this invention because it allows the passage of displaced oil to work back and forth as the piston moves up and down to dampen the bounce of bucket 110 as finish dirt scraper 100 traverses uneven ground. Oil return line 142 is connected to upper cylinder chamber space 138 by upper opening 144 and into lower cylinder chamber space 136 by lower opening 146 below piston 126. Oil return line 142 includes optional upper connector 148 and lower connector 150 to make the damper device of this invention easily accessible as needed to keep the system in balance.

Compression-expansion spring 124 is made form high-quality steel and must be adapted to over-all size and construction of damping device 106. A useful compression-expansion spring 124 is a spring marketed by John Deere Company as part number in 188865. This spring has a diameter of 0.375 inches, an outside spring diameter of 2.520 inches, a spring length of 10.280 inches, a compressed solid spring length of 5.440 inches and 14.500 coils. This spring is made from steel identified as A15-3.

The oil used in the damping device of this invention is a standard hydraulic fluid. Any known low-viscosity hydraulic oil may be used in this invention. A useful is Case Standard Hydraulic Oil marketed by Case-International Harvester Company.

Generally, dampening device 106 of this invention will be used in pairs on the buckets of conventional finished dirt scrapers. Three or more dampening devices may be used in connection with very large buckets and one dampening may be adequate for very small buckets.

FIG. 3 is a schematic view showing the up and down working of compression-expansion spring 124, piston 126 working up and down in lower cylinder chamber 128 with oil by-passing back and forth through orifice 132 and oil moving back and forth in oil return line 142.

Although the preferred embodiment of this invention has been described herein, the an invention is adapted for use in any equipment where a bucket with a blade is used in any equipment to pick up, move, and transport dirt or other frangible materials.

Thus, there has been shown and described a novel improved dampening device for finish dirt scrapers. It will be apparent to those skilled in the art, however, that many changes, modifications, variations and other uses and applications for the subject invention are possible. All such changes, modifications, variations and other uses and applications which do not depart from the spirit and the scope of the invention are deemed to be covered by the invention, which is limited only by the claims which follow.

What is claimed is:

1. In a dirt leveling device having a frame with a bucket rotatably attached to said frame and a hydraulically actuated piston in a cylinder sleeve attached to said frame and to said bucket, The improvement comprised of a damping device attached to said bucket wherein the upper end of said damping device is rotatably attached to an arm extending substantially perpendicular to and attached to the back of said bucket and wherein the lower end of said damping device is attached to a skid shoe, said skid shoe being hingedly attached to the bottom of said bucket, said damping device having a shaft with the lower end of said shaft movably attached to said skid shoe and the upper end of said shaft attached to a piston which operates in a cylinder, wherein said cylinder has a divider therein which separates said cylinder into a lower chamber of said cylinder and an upper chamber of said cylinder, said divider having an orifice from said lower chamber into said upper chamber adapted to restrain oil passage when said piston is projected upward, said damping device having a by-pass oil line with the upper end of said by-pass oil line opening into said upper chamber of said cylinder and the lower end of said by-pass oil line opening into the lower chamber of said cylinder below said piston, wherein a compression-expansion spring surrounds said shaft with the lower end of said compression-expansion spring working against said skid shoe and the upper end of said compression-expansion spring working against the bottom of said cylinder to keep said skid shoe on the ground, said piston working in a closed oil system, and said piston and said compression-expansion spring adapted to work in unison to dampen the normal bounce as said dirt leveling device is operated at high speeds.

2. The invention according to claim 1 wherein said oil by-pass line contains a removable section with a pair of connectors on each end adapted to replace and supplement said oil supply.

3. The invention according to claim 1 wherein a breather tube projects from said upper chamber of said cylinder adapted to vent excess air without venting oil.

4. The invention according to claim 1 wherein a said lower chamber of said cylinder is larger than the upper chamber of said cylinder.

5. The invention according to claim 1 wherein said piston is adapted to operate only in said lower chamber of said cylinder.

* * * * *